US006824230B2

(12) United States Patent
Probst

(10) Patent No.: US 6,824,230 B2
(45) Date of Patent: Nov. 30, 2004

(54) CORNER COMPUTER WORKCENTER

(75) Inventor: Richard Probst, Lamar, MO (US)

(73) Assignee: O'Sullivan Industries, Inc., Lamra, MO (US)

( * ) Notice: Subject to any disclaimer, the term of this patent is extended or adjusted under 35 U.S.C. 154(b) by 17 days.

(21) Appl. No.: 09/952,562

(22) Filed: Sep. 12, 2001

(65) Prior Publication Data

US 2003/0184194 A1 Oct. 2, 2003

(51) Int. Cl.[7] ..... A47B 81/00

(52) U.S. Cl. ..... 312/223.3; 312/258; 312/196; 108/50.01

(58) Field of Search ..... 108/92, 93, 101, 108/50.01, 50.02; 312/194, 195, 196, 223.3

(56) References Cited

U.S. PATENT DOCUMENTS

| | | | | | |
|---|---|---|---|---|---|
| 2,223,196 | A | * | 11/1940 | Watkins | 312/223.3 |
| 3,471,947 | A | * | 10/1969 | Genser | 434/307 R |
| 4,258,963 | A | * | 3/1981 | Fusselman et al. | 312/194 |
| 4,345,803 | A | * | 8/1982 | Heck | 312/208.1 |
| 4,449,762 | A | * | 5/1984 | Turner | 312/223.3 |
| 4,626,655 | A | | 12/1986 | Angerer | |
| 4,646,655 | A | * | 3/1987 | Robolin | 108/92 |
| 4,936,228 | A | * | 6/1990 | Capo-Bianco | 108/64 |
| 5,044,284 | A | * | 9/1991 | Gross | 108/10 |
| 5,294,087 | A | | 3/1994 | Drabczyk et al. | |
| 5,324,036 | A | * | 6/1994 | Morrow | 463/47 |
| 5,610,798 | A | * | 3/1997 | Lochridge | 312/223.3 |
| 5,615,936 | A | * | 4/1997 | Simmons et al. | 312/238 |
| 5,746,489 | A | * | 5/1998 | Moon | 312/223.3 |
| 5,752,449 | A | * | 5/1998 | Simon et al. | 108/50.02 |
| 5,791,259 | A | * | 8/1998 | Mansfield et al. | 108/6 |
| 5,797,666 | A | * | 8/1998 | Park | 108/50.01 |
| 5,857,415 | A | * | 1/1999 | Richard | 108/50.01 |
| 5,865,125 | A | * | 2/1999 | Alexander et al. | 108/50.11 |
| 5,896,817 | A | * | 4/1999 | Hancock | 108/13 |
| 5,957,059 | A | * | 9/1999 | Burhman | 108/50.01 |
| 5,961,192 | A | | 10/1999 | Bernart et al. | |

(List continued on next page.)

FOREIGN PATENT DOCUMENTS

| | | | |
|---|---|---|---|
| DE | 422510 | * | 4/1991 |
| DE | 29708894 U | | 8/1997 |
| DE | 29713332 U1 | | 1/1998 |
| GB | 2252241 | * | 8/1992 |
| GB | 2348361 | | 10/2000 |
| US | WO 200030499 | * | 6/2000 |
| WO | WO 00/03621 | | 1/2000 |

OTHER PUBLICATIONS

Snowcrash Information Sheet, Netsurfer, 1995, pp. 1–2.*
Catalogue—Workspheres, p. 98.

*Primary Examiner*—Peter M. Cuomo
*Assistant Examiner*—Stephanie Harris
(74) *Attorney, Agent, or Firm*—Haynes and Boone, LLP

(57) ABSTRACT

A corner computer workcenter is described that includes an arrangement for positioning a CPU of a computer proximate to a monitor, keyboard, and other peripheral devices thereof an at a height with respect to the user that facilitates access to media drives and power switches. In one embodiment, the corner computer workcenter of the present invention includes a first horizontal surface for supporting a computer monitor, a second horizontal surface comprising a work surface located in front of and beneath the first surface, and a third horizontal surface located below the work surface for supporting a computer keyboard and other input devices. A shelf, the vertical height of which may be adjustable, is included for positioning a CPU of the computer just below the monitor and behind the work surface and keyboard support surface so that cables provided with the computer for connecting the monitor, keyboard, and other input devices to the CPU are of sufficient length to serve their intended purpose. Casters are provided at each side of the bottom, rear of the workcenter to facilitate access to the rear of the CPU and other computer components.

17 Claims, 5 Drawing Sheets

U.S. PATENT DOCUMENTS 6,053,116 A * 4/2000 Jung et al. ..... 108/115
6,158,831 A * 12/2000 Brown et al. ..... 312/258
6,161,487 A * 12/2000 Chang ..... 108/50.01
6,170,406 B1 * 1/2001 Klein et al. ..... 108/50.01
6,220,182 B1 * 4/2001 Duffy et al. ..... 108/50.11
6,305,766 B1 * 10/2001 Lochridge ..... 312/223.3
6,541,256 B1 * 4/2003 Chen et al. ..... 435/405

* cited by examiner

CORNER COMPUTER WORKCENTER

BACKGROUND

The present invention relates generally to computer workcenters and, more specifically, to a corner computer workcenter designed such that the CPU of a computer is positioned just below the monitor thereof and beyond a work surface of the workcenter for ease of access to the CPU and computer peripherals.

Various types of computer workcenters designed to accommodate the components of a computer, including a monitor, CPU, I/O and other peripherals, and perhaps a printer, and including a work surface are known in the art. It is typically advantageous to design such workcenters such that they may be easily positioned in the corner of a room, so as to take up as little space as possible.

Typically, such workcenters suffer from several deficiencies. In particular, the CPU is generally positioned in an inconvenient location or an inconvenient distance from the monitor and/or work surface, such that the cables provided with the computer are not of sufficient length to enable proper use or connection of the peripheral devices. Additionally, the ports are often difficult for the user to access due to the positioning of the CPU within the workcenter. Still further, when the CPU is positioned close to the floor, as is typically the case, access to media drives, as well as power switches, is inconvenient. Finally, if the CPU is enclosed in a cabinet of the workcenter, it may be difficult, if not impossible, to provide sufficient ventilation for the unit.

Moreover, because corner computer workcenters are, by definition, designed for placement in a corner of a room, it is often difficult to access the back of the computer components where many of the ports and connectors are located. Because of the size of the workcenter, in addition to the weight of the computer, it is next to impossible for one person to move the workcenter once it and the computer are in place.

Therefore, what is needed is a computer corner workcenter that addresses one or more of the above-described problems.

SUMMARY

A desk, such as a corner computer workcenter, is provided that includes an arrangement for positioning a CPU of a computer proximate to a monitor, keyboard, and other peripheral devices thereof and at a height with respect to the user that facilitates access to media drives and power switches.

In one example, the corner computer workcenter includes a first horizontal surface for supporting a computer monitor, a second horizontal surface comprising a work surface located in front of and beneath the first surface, and a third horizontal surface located below the work surface for supporting a computer keyboard and other input devices. A shelf is included for positioning a CPU of the computer just below the monitor and behind the work surface and keyboard support surface so that cables provided with the computer for connecting the monitor, keyboard, and other input devices to the CPU are of sufficient length to serve their intended purpose. Casters are provided at each side of the bottom, rear of the workcenter to facilitate access to the rear of the CPU and other computer components.

The workcenter may thus position the CPU in a convenient location for enabling the user to access media drives and switches and in proximity to the monitor and/or work surface, so that the cables provided with the computer are of sufficient length to enable proper use and connection of the peripheral devices. Additionally, the ports may be rendered more accessible to the user due to the positioning of the CPU within the workcenter. Moreover, because the CPU is not completely enclosed within a cabinet of the workcenter, sufficient ventilation is provided.

DESCRIPTION

Figure 1A:
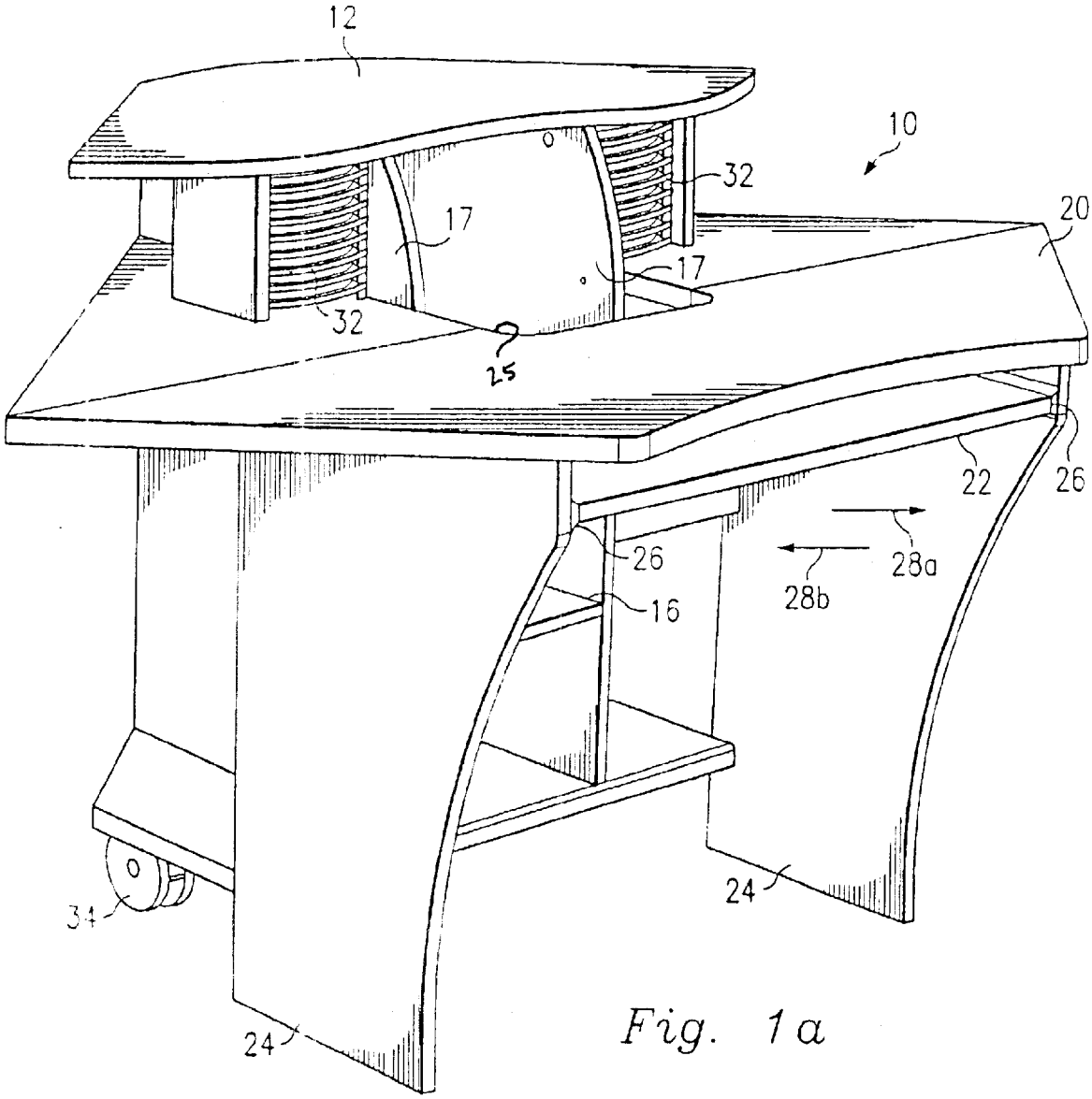
FIG. 1*a* is a front perspective view of the corner computer workcenter of the present invention.
Figure 1B:
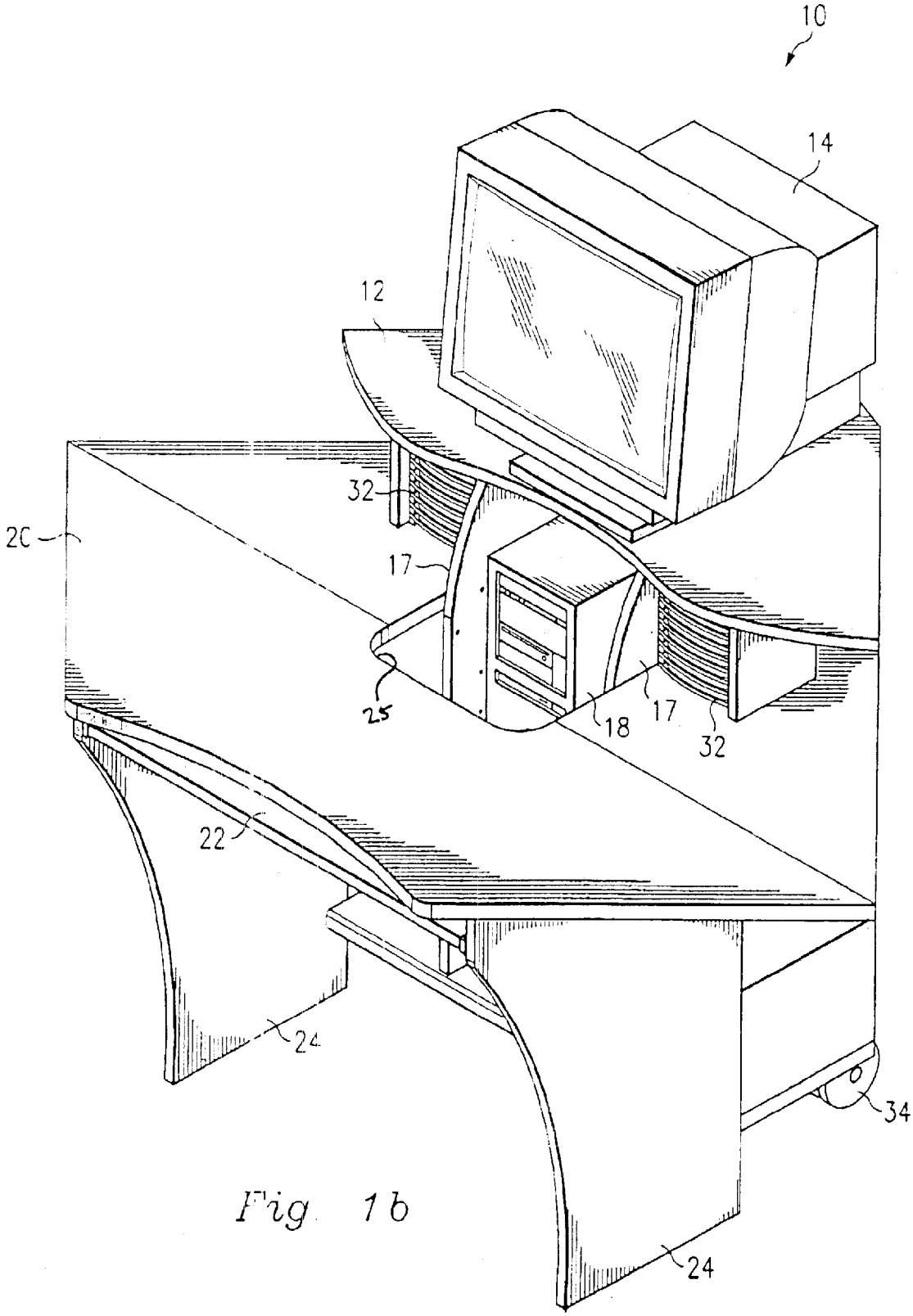
FIG. 1*b* is an overhead, front view of the corner computer workcenter of the present invention.
Figure 2:
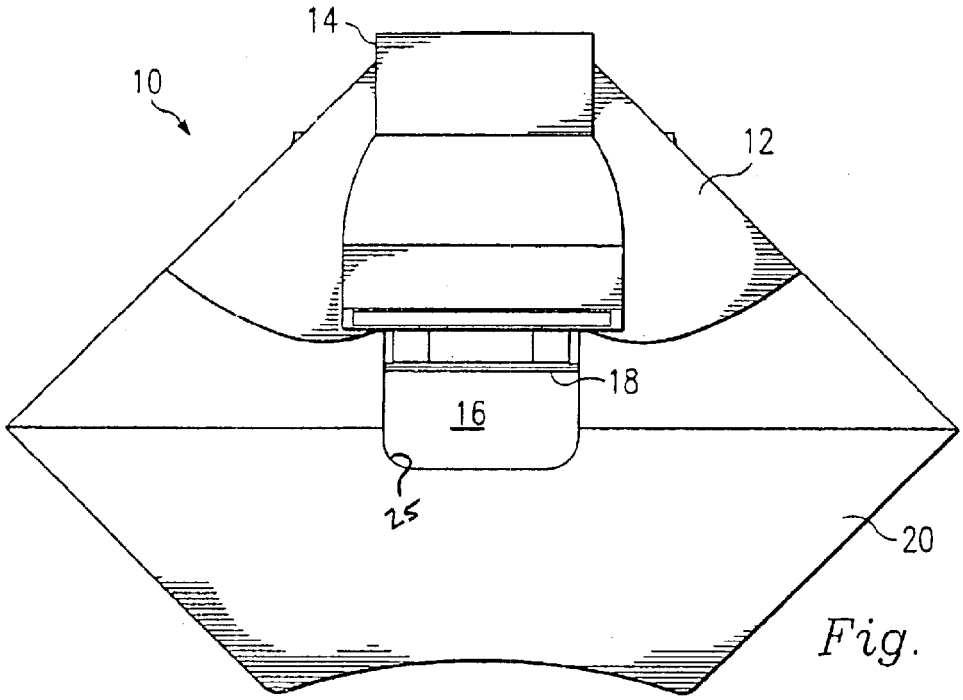
FIG. 2 is a top isometric view of the corner computer workcenter of FIGS. 1*a* and 1*b*.
Figure 3:
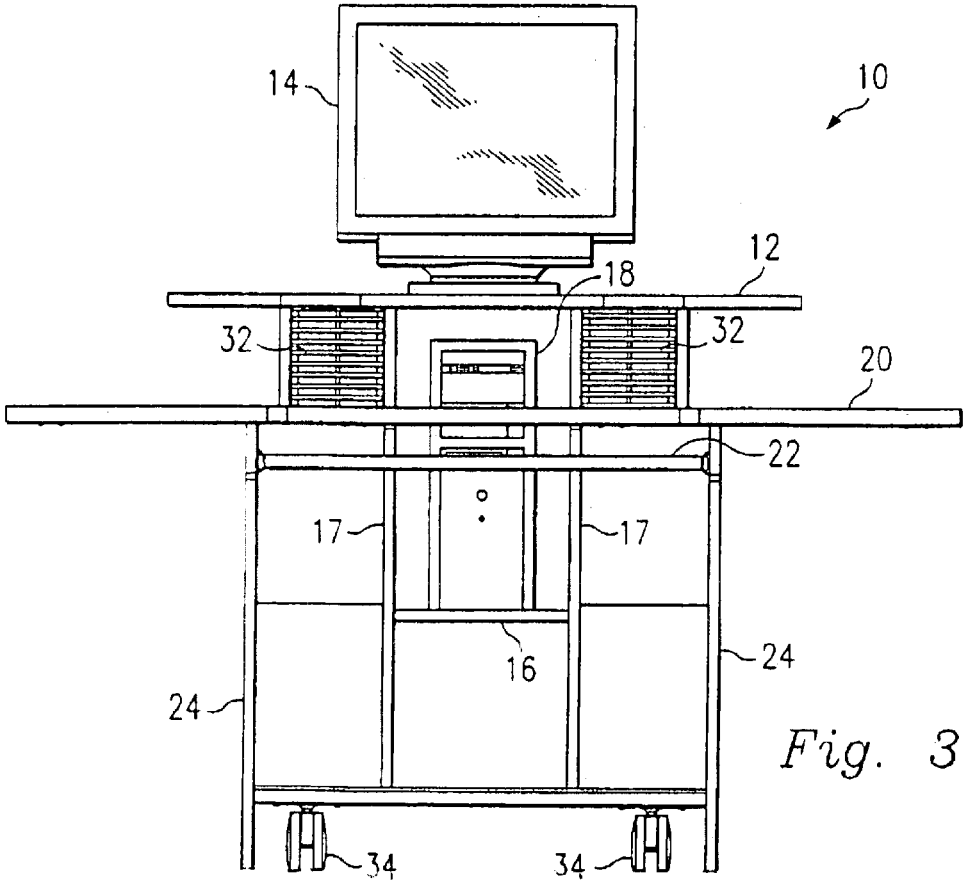
FIG. 3 is a front isometric view of the corner computer workcenter of FIGS. 1*a* and 1*b*.

Referring to FIGS. 1*a*, 1*b*, and 2–3, the reference numeral 10 refers in general to a corner computer workcenter. The workcenter 10 includes a first horizontal surface 12 for supporting a computer monitor 14 (not shown in FIG. 1*a*). A first pair of parallel, spaced, vertically-extending sidewalls 17 are connected to the bottom of the surface 12. A shelf 16 for supporting a CPU 18 (not shown in FIG. 1*a*) is connected between the sidewalls 17 such that the shelf 16 is positioned below the surface 12. In one example, the vertical height of the shelf 16 is adjustable and is connected to the sidewalls 17 in such a manner that it may be easily raised and lowered thereby to adjust the vertical position of the CPU 18 beneath the monitor 14 with respect to a work surface 20 and to accommodate different size CPUs. Although not shown, it will be recognized that the CPU 18 is connected to the monitor 14 positioned thereabove via one or more cables (not shown) designed for that purpose in a conventional manner. Second and third horizontal surfaces 20 and 22 are located below the first horizontal surface and respectively function as a user work surface and a keyboard support surface, as will be described.

The second horizontal surface 20 is connected over a second pair of parallel, spaced, vertically-extending sidewalls 24, which also function as legs for the workcenter 10. An aperture 25 is defined by the surface 20 through which the CPU 18 may extend. The third horizontal surface 22 is connected below the second horizontal surface 20 between the sidewalls 24 via slide guides 26, thus enabling a user positioned in front of the workcenter 10 to slide the surface 22 out toward the user, in a direction indicated by an arrow 28*a* (FIG. 1*a*), in order to access a keyboard or other input device, such as a mouse (not shown), supported thereon and subsequently to slide the surface back away from the user, in a direction indicated by an arrow 28*b* (FIG. 1*a*), to store the keyboard.

Figure 5:
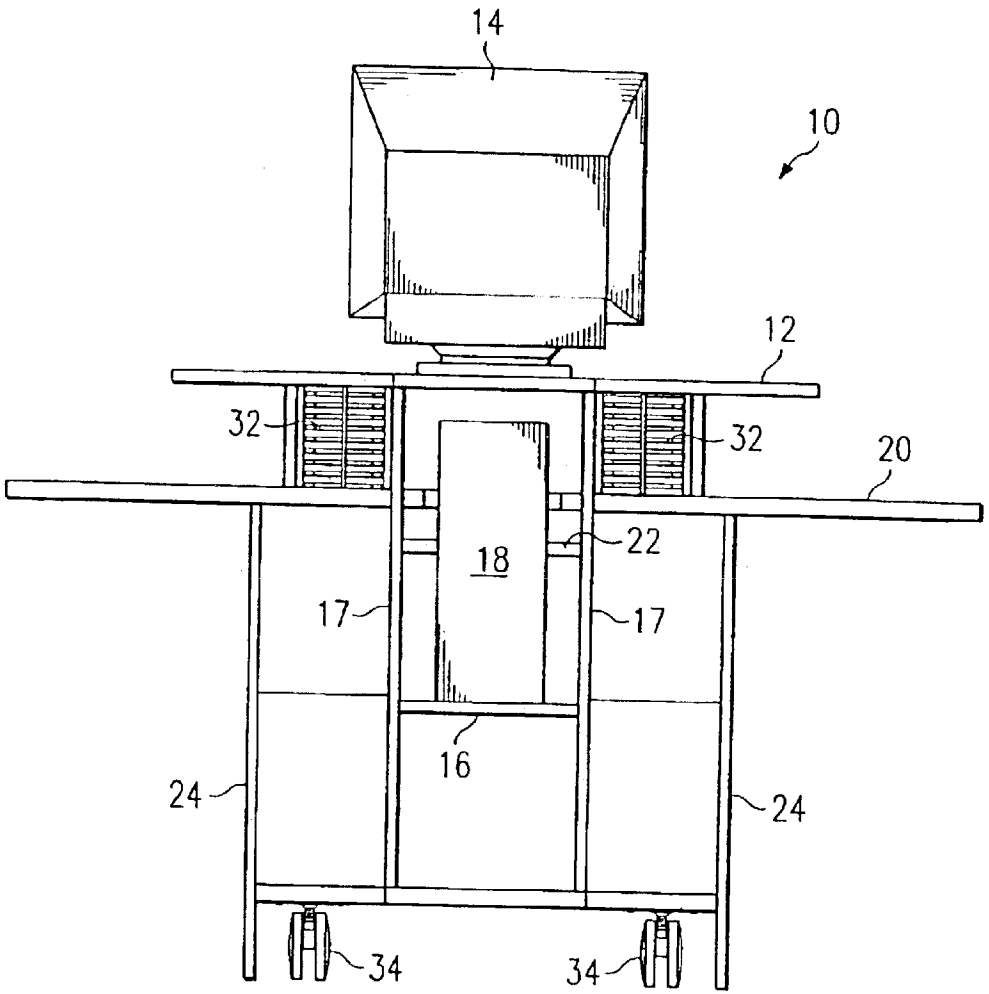
FIG. 5 is a rear isometric view of the corner computer workcenter of FIGS. 1*a* and 1*b*.
Figure 4:
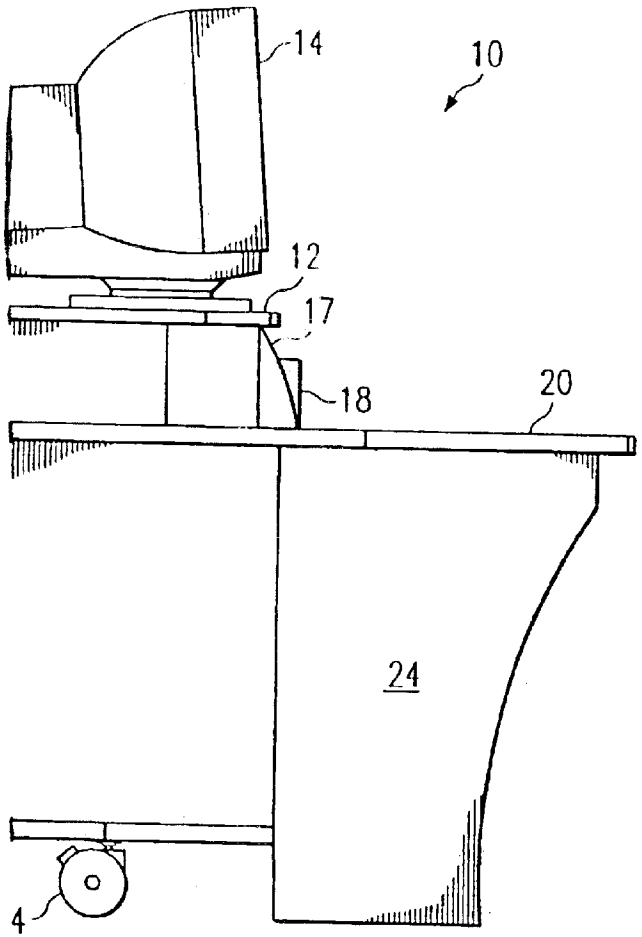
FIG. 4 is a left side isometric view of the corner computer workcenter of FIGS. 1*a* and 1*b*.
Figure 6:
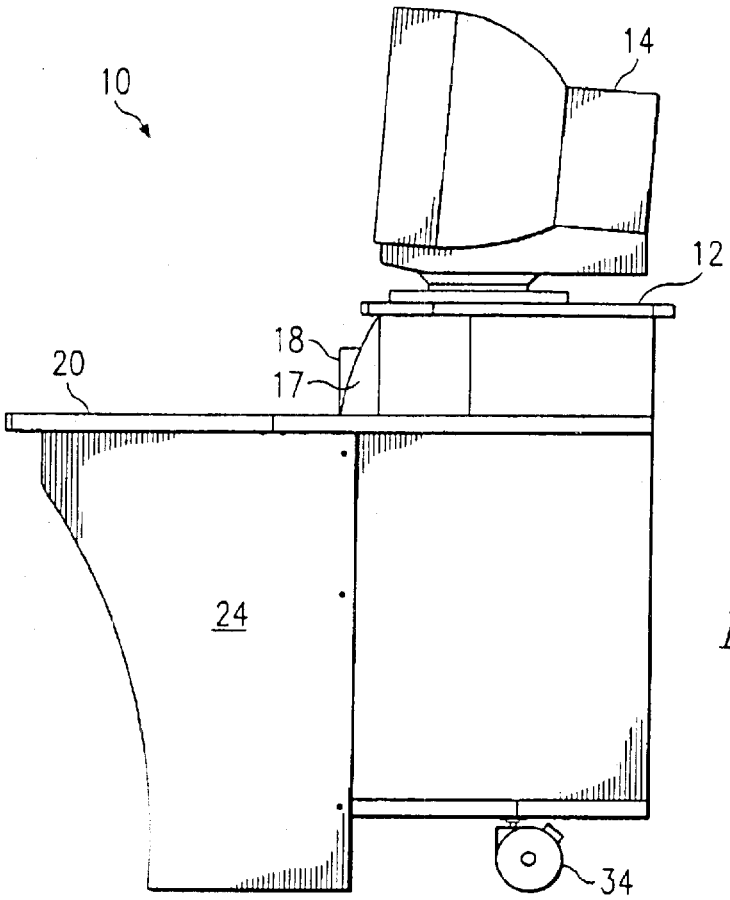
FIG. 6 is a right side isometric view of the corner computer workcenter of FIGS. 1*a* and 1*b*.
Figure 7:
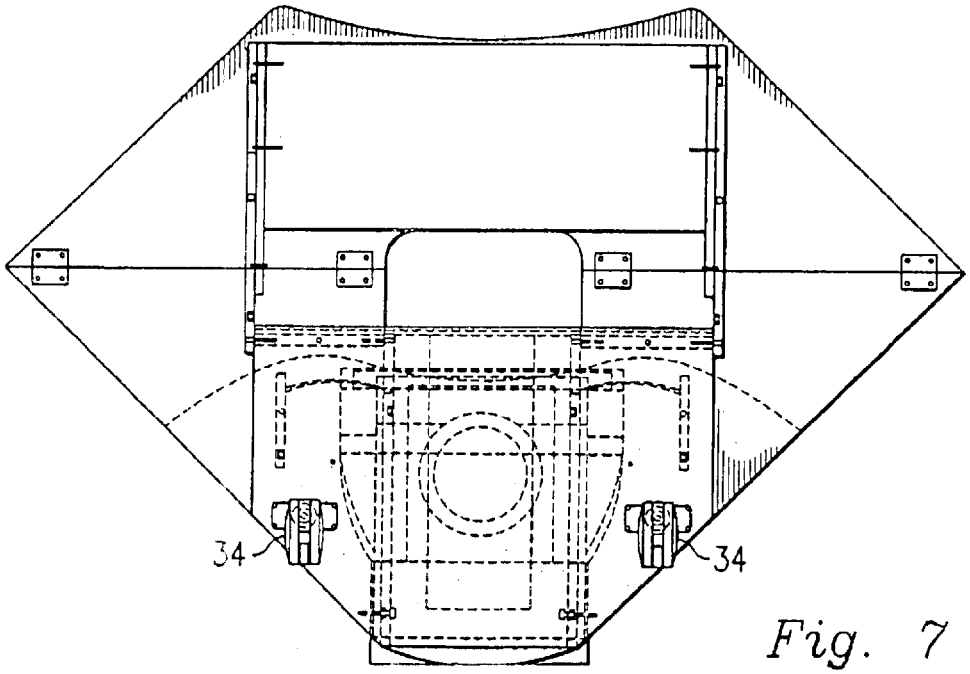
FIG. 7 is a bottom view of the corner computer workcenter of FIGS. 1*a* and 1*b*.

CD racks 32 may also be provided in one example, for holding compact disc media in a convenient and organized fashion to the left and right of the CPU 18. As best shown in FIGS. 4–7, casters 34 are provided at each side at the bottom rear of the workcenter 10 for facilitating movement of the workcenter 10 away from a corner in which it resides for ease of access to cabling on the rear of the CPU 18 and monitor 14.

As previously indicated, because the workcenter 10 positions the CPU 18 directly below the monitor 14 and behind the work surface 20, the user has greater access to the front of the CPU, such that loading media into drives and accessing ports, switches, etc., is easy and convenient. Moreover, positioning the monitor 14, keyboard, and other input devices in close proximity to the CPU 18 helps ensure that the cables provided with the devices will reach the CPU and that special length cables will not be required, as is often the case when the CPU is situated at ground level. Additionally, the workcenter 10 is semi-mobile, due to the positioning of the casters 34 on the bottom rear thereof, thus enabling movement of the workcenter when the computer and related components thereof are installed, replaced, or serviced and eliminating the need for the person performing such tasks to crawl under or squeeze behind the workcenter. Finally, the shelf 16 on which the CPU is supported within the workcenter 10 provides improved ventilation for heat dissipation.

Accordingly, in one example of the workcenter 10, the CPU 18 is positioned in a convenient location for enabling the user to access media drives and switches (not shown) and in proximity to the monitor 14 and/or work surface 20, such that the cables provided with the computer are of sufficient length to enable proper use and connection of the peripheral devices. Additionally, computer ports are rendered more accessible to the user due to the unique positioning of the CPU 18 within the workcenter 10 and mobility of the workcenter. Moreover, because the CPU 18 is not completely enclosed within a cabinet of the workcenter 10, sufficient ventilation is provided. Finally, the casters 34 provided on the bottom rear of the workcenter facilitate movement of the workcenter 10, thereby enabling access to the rear of the CPU 18 and other components.

It is understood that variations may be made in the foregoing without departing from the scope of the present invention. For example, the shelf 16 need not be adjustable; rather, its vertical height may be fixed. It is further understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A workcenter for supporting at least a computer monitor and CPU, comprising:

a first horizontal surface for supporting the computer monitor;

a first pair of parallel, spaced, vertically-extending sidewalls connected to the bottom of the first horizontal surface;

a shelf connected between the first pair of sidewalls below the first horizontal surface;

a second horizontal surface located below the first horizontal surface and above the shelf and having an aperture therethrough, the second horizontal surface being unitarily formed to provide a portion of the second horizontal surface in front of the aperture;

a second pair of parallel, spaced, vertically-extending sidewalls extending from the bottom of the second horizontal surface; and a third horizontal surface slidingly connected between the second pair of sidewalls;

wherein the first pair of sidewalls extend through the second horizontal surface aperture and the shelf is positioned such that a CPU is supported thereon and extends through the second horizontal surface aperture toward the first horizontal surface.

2. The computer workcenter of claim 1 further comprising casters provided on a bottom rear of the workcenter.

3. The computer workcenter of claim 1 further comprising a CD rack for housing compact disc media.

4. The computer workcenter of claim 3 wherein the CD rack is located on a top surface of the second horizontal surface proximate the CPU.

5. The computer workcenter of claim 1 wherein a vertical height of the shelf is adjustable.

6. The computer workcenter of claim 1 wherein the third horizontal surface is slidingly movable between a first position, in which the third horizontal surface is located underneath the second horizontal surface, and a second position, in which the third horizontal surface extends substantially in front of the second horizontal surface.

7. The computer workcenter of claim 1 wherein the second horizontal surface functions as a user work surface.

8. The computer workcenter of claim 1 wherein the third horizontal surface functions as a keyboard support surface.

9. The computer workcenter of claim 1 wherein the second pair of sidewalls function as legs for the computer workcenter.

10. A desk comprising:

means for supporting a computer monitor;

a horizontal work surface provided below the computer monitor supporting means and having an aperture therethrough, the horizontal work surface being unitarily formed to provide a portion of the horizontal surface in front of the aperture;

means for supporting a computer CPU below the computer monitor supporting means, the computer CPU supporting means being arranged to extend through the horizontal work surface aperture, such that the computer CPU extends through the work surface aperture and is located proximate to and vertically spaced from the computer monitor, wherein the computer CPU supporting means comprises:

a first pair of parallel, spaced, vertically-extending sidewalls connected to the bottom of the horizontal work surface; and a shelf connected between the first pair of sidewalls below the horizontal work surface; and a second pair of parallel, spaced, vertically-extending sidewalls extending from the bottom of the horizontal work surface; and means for supporting a keyboard slidingly connected between the second pair of sidewalls, wherein the keyboard supporting means is slidingly movable between a first position, in which the keyboard supporting means is located underneath the horizontal work surface, and a second position, in which the keyboard supporting means extends substantially in front of the horizontal work surface.

11. The desk of claim 10 wherein a vertical height of the shelf is adjustable.

12. The desk of claim 10 further comprising a CD rack for housing compact disc media.

13. The desk of claim 12 wherein the CD rack is positioned on a top surface of the horizontal work surface proximate the CPU.

14. The desk of claim 10 further comprising means for facilitating movement of the desk.

15. The desk of claim 14 wherein the means for facilitating movement comprises casters provided on a bottom rear of the desk.

16. A computer workcenter, comprising:

a first horizontal surface for supporting a computer monitor;

a first pair of parallel, spaced, vertically-extending sidewalls connected to the bottom of the first horizontal surface;

a shelf connected between the first pair of sidewalls below the first horizontal surface;

a second horizontal surface located below the first horizontal surface and above the shelf and having an aperture formed therethrough, the second horizontal surface being unitarily formed to provide a portion of the second horizontal surface in front of the aperture;

a second pair of parallel, spaced, vertically-extending sidewalls extending from the bottom of the second horizontal surface;

a third horizontal surface slidingly connected between the second pair of sidewalls for supporting a keyboard; and casters provided on a bottom rear of the workcenter;

wherein the first pair of sidewalls extend through the second horizontal surface aperture and the shelf is positioned such that a CPU supported thereon extends through the second horizontal surface aperture toward the first horizontal surface.

17. The computer workcenter of claim 16 wherein the shelf is connected between the first pair of sidewalls in such a manner that enables the vertical height of the shelf to be changed.

* * * * *